US012017109B2

(12) United States Patent
Ayala et al.

(10) Patent No.: US 12,017,109 B2
(45) Date of Patent: Jun. 25, 2024

(54) EXERCISE EQUIPMENT MOUNTING APPARATUS AND METHODS

(71) Applicant: Hydrow, Inc., Cambridge, MA (US)

(72) Inventors: Ray Ayala, Mansfield, MA (US); Joseph Carleo, Boston, MA (US); Adam Craft, Mansfield, MA (US); Emily Hart, Watertown, MA (US); Mark Matthews, Scituate, MA (US); Dennis Rogers, Somerville, MA (US)

(73) Assignee: Hydrow, Inc., Cambridge, MA (US)

( * ) Notice: Subject to any disclaimer, the term of this patent is extended or adjusted under 35 U.S.C. 154(b) by 76 days.

(21) Appl. No.: 17/743,077

(22) Filed: May 12, 2022

(65) Prior Publication Data

US 2023/0364462 A1 Nov. 16, 2023

(51) Int. Cl.
*A63B 22/00* (2006.01)

(52) U.S. Cl.
CPC ..... *A63B 22/0046* (2013.01); *A63B 2210/50* (2013.01)

(58) Field of Classification Search
CPC ..... A63B 22/0046; A63B 2210/50; A63B 2071/025; A63B 2225/093; A63B 71/0036
See application file for complete search history.

(56) References Cited

U.S. PATENT DOCUMENTS

| | | | | |
|---|---|---|---|---|
| 4,444,178 | A | 4/1984 | Kuo | |
| 4,921,245 | A * | 5/1990 | Roberts | A63B 7/02 482/42 |
| D368,747 | S * | 4/1996 | Gifford | D21/690 |
| 6,422,982 | B1 | 7/2002 | Retel | |
| 10,532,239 | B1 * | 1/2020 | Suarez Monne | A63B 17/04 |
| 11,253,739 | B2 * | 2/2022 | Freeman | A63B 21/0442 |
| 11,426,619 | B1 * | 8/2022 | Shane | A63B 23/1218 |
| 2006/0037228 | A1 | 2/2006 | Benson | |
| 2012/0186126 | A1 | 7/2012 | Bartak | |
| 2015/0367170 | A1 | 12/2015 | Robertson | |
| 2021/0093910 | A1 * | 4/2021 | Freeman | A63B 21/0442 |

OTHER PUBLICATIONS

PCT International Search Report and Written Opinion for PCT Application No. PCT/US2023/021472 dated Aug. 4, 2023.

* cited by examiner

*Primary Examiner* — Andrew S Lo
*Assistant Examiner* — Andrew M Kobylarz
(74) *Attorney, Agent, or Firm* — Duane Morris LLP

(57) ABSTRACT

A mounting apparatus for exercise equipment includes a first elongate support member having a first end, a second end, and a connector positioned along a first portion of the first elongate support member and arranged to detachably connect to a portion of the exercise equipment. The mounting apparatus further includes a second elongate support member having a first end and a second end meeting the first end of the first elongate support member at a first vertex. The mounting apparatus further includes a third elongate support member having a first end and a second end meeting the first end of the first elongate support member at a second vertex.

36 Claims, 8 Drawing Sheets

EXERCISE EQUIPMENT MOUNTING APPARATUS AND METHODS

TECHNICAL FIELD

This application relates generally to exercise equipment and, more particularly, to techniques for storing exercise equipment.

BACKGROUND

Exercise equipment typically includes a large apparatus designed for use in a variety of commercial and non-commercial settings. However, to ensure structural stability during use, traditional exercise equipment is often bulky and can be difficult to store.

Accordingly, there is a need for a more efficient, reliable, and less obtrusive exercise mounting system to reduce the footprint of such equipment during storage.

SUMMARY

The application, in various implementations, addresses deficiencies associated with storing existing exercise equipment. The application includes an exemplary apparatus and methods that enable more efficient, reliable, and less obtrusive storage of exercise equipment while the equipment is not operating.

This application describes exemplary apparatuses and methods that provide a means for storing exercise equipment by way of a removable stand.

In one aspect, a mounting apparatus for exercise equipment is disclosed. The mounting apparatus may include a first elongate support member having a first end and a second end. The first elongate support member may include a connector positioned along a first portion of the first elongate support member and arranged to detachably connect to a portion of the exercise equipment.

The mounting apparatus may further include a second elongate support member having a first end and a second end. The first end of the second elongate support member may meet the first end of the first elongate support member at a first vertex. The second end of the first elongate support member may be spaced away from the second end of the second elongate support member to form the first vertex of a first angle between the first and second elongate support members.

The mounting apparatus may further include a third elongate support member having a first end and a second end. The first end of the third elongate support member may meet the first end of the first elongate support member at a second vertex. The second end of the first elongate support member may be spaced away from the second end of the third elongate support member to form the second vertex of a second angle between the first and third elongate support members. The second end of the second elongate support member may be spaced away from the second end of the third elongate support member to form a third vertex of a third angle between the second and third elongate support members.

In one implementation, when the exercise equipment is in an operational orientation along a surface and the mounting apparatus is connected to the exercise equipment, the second and third elongate support members are not in contact with the surface. In another implementation, when the exercise equipment is in a storage orientation along the surface and the mounting apparatus is connected to the exercise equipment, a portion of the second elongate support member and a portion of the third elongate support member are in contact with the surface. In another implementation, the second and third elongate support members may extend within a plane that is substantially parallel to the surface.

In one implementation, the mounting apparatus includes a fourth elongate support member including a first end and a second end. The first end of the fourth elongate support member may meet a second portion of the first elongate support member, and the second end of the fourth elongate support member may meet a portion of the second elongate support member. In another implementation, the first end of the fourth elongate support member meets the second end of the first elongate support member and the second end of the fourth elongate support member meets the second end of the second elongate support member. In another implementation, the first, second, and fourth elongate support members form a first triangular arrangement.

In one implementation, the mounting apparatus includes a fifth elongate support member including a first end and a second end. The first end of the fifth elongate support member may meet a second portion of the first elongate support member, and the second end of the fifth elongate support member may meet a portion of the third elongate support member. In another implementation, the first end of the fifth elongate support member meets the second end of the first elongate support member and the second end of the fifth elongate support member meets the second end of the third elongate support member. In another implementation, the first, third, and fifth elongate support members form a second triangular arrangement.

According to one implementation, the angle of at least one of the first angle and the second angle of the mounting apparatus is between 1 degree and 90 degrees. According to another implementation, at least one of the first angle and the second angle is between 30 degrees and 90 degrees. According to one implementation, at least one of the first angle and the second angle is configured to enable the exercise equipment to rest on the mounting apparatus in the storage orientation. According to another implementation, a distance between the second end of the second elongate support member and the second end of the third elongate support member is wider than a width of the first elongate support member.

According to one implementation, mounting apparatus includes at least one wheel positioned at or proximate to at least one of the second end of the second elongate support member and second end of the third elongate support member to enable the mounting apparatus to move along the surface. According to another implementation, each of the first, second, third, fourth, and fifth elongate support members of mounting apparatus includes a beam. In some implementations, the beam includes one or more support ribs and/or grooves. In some implementations, the beam is formed of at least one of a metal, plastic, and a composite material.

According to one implementation, the connecter of mounting apparatus includes a hinged latch being configured to secure the exercise equipment to the mounting apparatus. In some implementations, the first elongate support member includes a hinged back panel having a first side and second side. The first side and second may be configured to rotate to a closed position when the first side and second side are aligned in substantially the same plane and to rotate to an open position when the first side and the second side are not aligned in the same plane. In some implementations, the first elongate support member defines a channel between the connector and hinged back panel when the hinged back panel is in a closed position and the connector is in a closed position.

According to another aspect, mounting apparatus includes a triangular support apparatus for securing exercise equipment. Triangle support apparatus may include a hypotenuse side, including a hinged latch and a grooved and/or ribbed interior. Thereby, the hinged latch and grooved and/or ribbed interior may be configured to secure an exercise equipment disposed upright. Triangle support apparatus may also include an opposite side including two grooved support beams oriented at a right angle. Triangle support apparatus may further include an adjacent side, including two grooved and/or ribbed horizontal support beams. The opposite side and the adjacent side may meet at a first and a second shared angle joining the two grooved and/or ribbed support beams oriented at a right angle and the two grooved and/or ribbed horizontal support beams respectively. The first and the second shared angle may include at least one wheel on each of the first and the second shared angle.

In another aspect, the disclosure includes a process for storing exercise equipment. This process includes connecting a mounting apparatus to a portion and frame component of the exercise equipment while the exercise equipment is in an operational orientation along a surface. According to some implementations, the mounting apparatus includes, i) a first elongate support member having a first end and second end and a connector therebetween that enables the connecting to the exercise equipment, ii) a second elongate support member having a first end meeting the first end of the first elongate support member, wherein the second elongate support member is not in contact with the surface, and iii) a third elongate support member having a first end meeting the first end of the first elongate support member. The process may further include changing the orientation of the exercise equipment from the operational orientation to a storage orientation. The second and third elongate support members may be adjacent to the surface when the exercise equipment is in the storage orientation.

According to one implementation, changing the orientation of the exercise equipment includes tilting the exercise equipment toward the surface until the portion of the second elongate support member contacts the surface. According to another implementation, connecting a mounting apparatus to a portion and frame component of the exercise equipment while the exercise equipment is in an operational orientation along a surface includes engaging the connector with the portion of a frame of the exercise equipment.

According to one implementation, the third elongate support member includes a first end and second end. The first end may be connected to the second end of the first elongate support member and the second end may be connected to a second end of the second elongate support member. According to another implementation, at least one of the first, second, and third elongate support members includes at least two beams and arranged to be engaged together when the mounting apparatus is connected to the exercise equipment and arranged to be spaced apart when the mounting apparatus is not connected to the exercise equipment.

In a further aspect, a triangular support apparatus for securing exercise equipment includes a first hypotenuse side arranged to extend adjacent to a surface when the exercise equipment is in a storage position. The apparatus includes a first leg side having a hinged latch arranged to couple the triangular support apparatus to a portion of a frame of the exercise equipment. The apparatus also includes a second leg side having at least one wheel positioned proximate to an end adjacent to the first hypotenuse side. The first hypotenuse side, the first leg side, and the second leg side form a first triangle. The apparatus further includes a second hypotenuse side arranged to extend adjacent to the surface when the exercise equipment is in the storage position. The apparatus also includes a third leg having at least one wheel positioned proximate to an end adjacent to the second hypotenuse side. The second hypotenuse side, the first leg side, and the third leg side form a second triangle Any two or more of the features described in this specification, including in this summary section, may be combined to form implementations not specifically described in this specification.

The details of one or more implementations are set forth in the accompanying drawings and the following description. Other features and advantages will be apparent from the description and drawings, and from the claims.

BRIEF DESCRIPTION OF THE DRAWINGS

Like reference numerals in different figures indicate like elements.

DETAILED DESCRIPTION

The application, in various implementations, addresses deficiencies associated with storing existing exercise equipment. The application includes exemplary apparatuses and methods that enable more efficient, reliable, and less obtrusive storage of exercise equipment while the equipment is not operating. The removable stand can attach to the frame of the exercise equipment, such as a rower, so that it can be safely stored upright, and thereby, take up less space during storage while remaining secured in place. To operate, it is envisioned that a user can clamp the stand around the frame of the rower, and then secure it via a latch. The user can then lift the rower by its tail and pivot the rower forward to wheel the rower into the desired storing position. Then, the user can tip the rower upright as the stand secures it against a floor surface.

Figure 1:
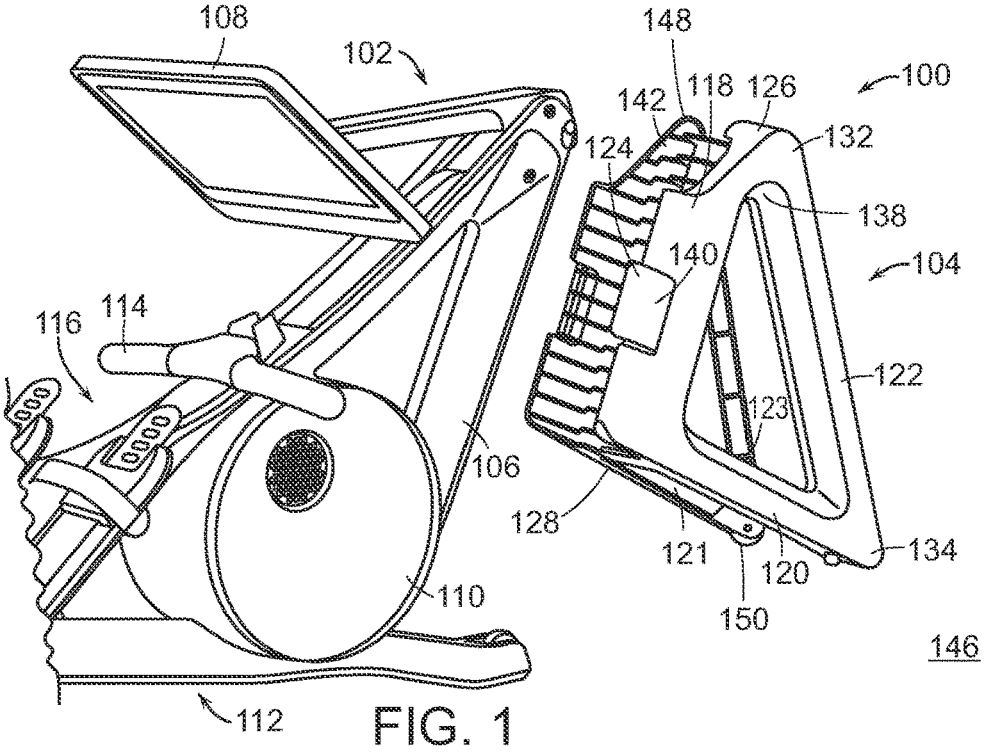
FIG. 1 shows a view of an exercise equipment system including exercise equipment in an operational orientation and a mounting apparatus.

FIG. 1 shows a view of an exercise equipment system 100 including exercise equipment 102 in an operational orientation and a mounting apparatus 104. Exercise equipment 102 includes a forward frame portion 106, a display 108, and a flywheel housing 110 that houses a flywheel. Exercise equipment 102 may include a base 112, a rowing handle 114, user seat (not shown), and foot rests 116. Mounting apparatus 104 may include a first elongate support member 118 and second elongate support member 122 and third elongate support member 123. In one implementation, mounting apparatus 104 includes a fourth elongate support member 120 and/or a fifth elongate support member 121. The first elongate support member 118 may include a connector 124 arranged along a portion of the support member 118. The first elongate support member 118 may include a first end 126 and second end 128. The second elongate support member 122 may include a first end 132 and second end 134. The third elongate support member 123 may include a first end 148 and second end 150. Connector 124 may include a hinged latch 140 and grooved and/or ribbed interior 142 including a plurality of support ribs. In some implementations, the internals of a support member and/or beam are substantial empty or include air space, but include support ribs 506 to provide structural strength and/or rigidity for mounting apparatus 104 while reducing the amount of material used and/or the weight of mounting apparatus 104.

FIG. 1 illustrates how connector 124 is arranged along a portion of elongate support member 118 to enable mounting apparatus 104 to detachably connect to a portion of the exercise equipment 102. According to one implementation, the first end 132 of the second elongate support member 122 meets and/or converges with the first end 126 of the first elongate support member 118 at a vertex 138 (shown in FIG. 2A and FIG. 3). This configuration further includes the second end 128 of the first elongate support member 118 spaced away from the second end 134 of the second elongate support member 122 to form the vertex 138 of an angle between the first and second elongate support members 118 and 122, respectively. Similarly, in some implementations, the first end 148 of the third elongate support member 123 meets and/or converges with the first end 126 of the first elongate support member 118 at a vertex 139 (shown in FIG. 2B and FIG. 3). This configuration further includes the second end 128 of the first elongate support member 118 being spaced away from the second end 150 of the third elongate support member 123 to form the vertex 139 of an angle between the first and third elongate support members 118 and 123, respectively. In some implementations, the angles of the vertices 138 and 139 are the same. In some implementations, when the exercise equipment 102 is in an operational orientation along a surface 146 and the mounting apparatus 104 is connected to the exercise equipment 102 as illustrated in FIG. 1, the second and third elongate support members 122 and 123 are not in contact with the surface 146.

Figure 2A:
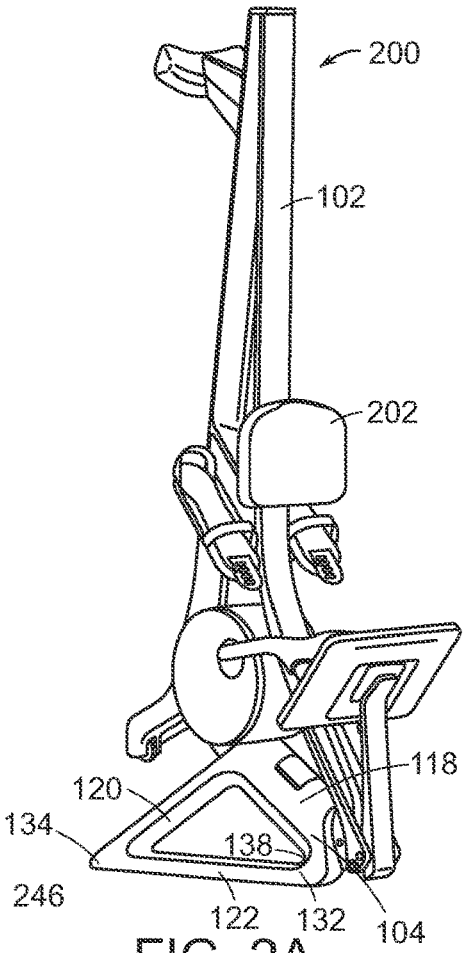
FIGS. 2A and 2B show views of the system of FIG. 1 with the mounting apparatus connected to the exercise equipment while the exercise apparatus is in a storage orientation.

FIG. 2A shows a view 200 of the system 100 of FIG. 1 with the mounting apparatus 104 connected to the exercise equipment 102 while the exercise equipment 102 is in a storage orientation.

Figure 2B:
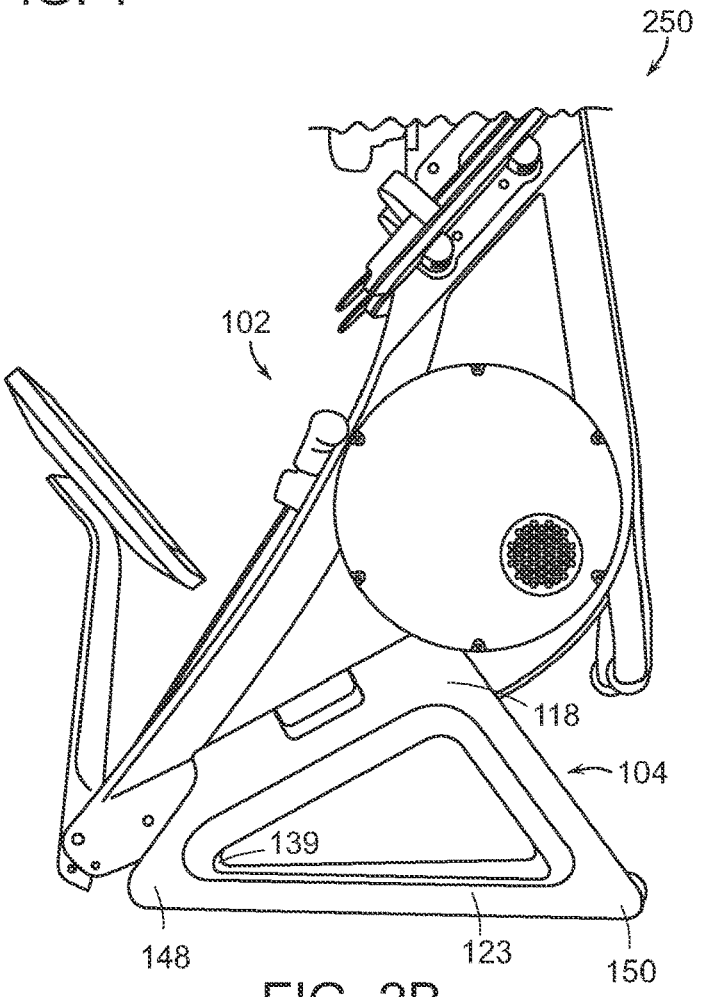

FIG. 2B shows another view 250 of the system 100 of FIG. 1 with the mounting apparatus 104 connected to the exercise equipment 102 while the exercise equipment 102 is in storage orientation. According to one implementation, when the exercise equipment 102 is in a storage orientation along the surface 146 and the mounting apparatus 104 is connected to the exercise equipment 102, a portion of the second elongate support member 122 and a portion of the third elongate support member 123 are in contact with the surface 146. In this way, the second and third elongate support members 122 and 123 extend within a plane that is substantially parallel to the surface 146.

Mounting apparatus 104 may include a fourth elongate support member 120 including a first end 152 and a second end 154 According to one implementation, the first end 152 of the fourth elongate support member 120 meets a second portion of the first elongate support member 118, and the second end 154 of the fourth elongate support member 120 meets a portion of the second elongate support member 122. The first end 152 of the fourth elongate support member 120 may meet the second end 128 of the first elongate support member 118 and the second end 154 of the fourth elongate support member 120 may meet the second end 134 of the second elongate support member 122. According to another implementation, the first, second, and fourth elongate support members 118, 122, and 120, respectively, of mounting apparatus 104 form a first triangle or triangular arrangement 302.

Mounting apparatus 104 may include a fifth elongate support member 121 including a first end 156 and a second end 158. According to one implementation, the first end 156 of the fifth elongate support member 121 meets a second portion of the first elongate support member 118, and the second end 158 of the fifth elongate support member 121 meets a portion of the third elongate support member 123. The first end 156 of the fifth elongate support member 121 may meet and/or converge with the second end 128 of the first elongate support member 118 and the second end 158 of the fifth elongate support member 121 may meet the second end 150 of the third elongate support member 123. The first, third, and fifth elongate support members 118, 123, and 121, respectively, of mounting apparatus 104 may form a second triangle or second triangular arrangement 304.

The angle of vertex 138 and/or 139 of mounting apparatus 104 may be between 1 degree and 90 degrees. In some implementations, the angle of vertex 138 and/or 139 is between 30 degrees and 90 degrees. According to one implementation, at least one of angle of vertex 138 and vertex 139 is configured to enable the exercise equipment 102 to rest on the mounting apparatus 104 in the storage orientation. According to another implementation, a distance between the second end 134 of the second elongate support member 122 and the second end 150 of the third elongate support member 123 is wider than a width of the first elongate support member 118. In some implementations, the second elongate support member 122 and third elongate support member 123 form a V-shaped arrangement along the surface 146.

Mounting apparatus 104 may further include a wheel 402 positioned at or proximate to the second end 134 of the second elongate support member 122 and a wheel 404 positioned at or proximate to the second end 150 of the third elongate support member 123 to enable the mounting apparatus 104 to move along the surface 146. According to one implementation, each of the first, second, third, fourth, and fifth elongate support members 118, 122, 123, 120, and 121, respectively, of mounting apparatus 104 includes a beam. In some implementations, the beam includes multiple support ribs 506 and grooves or spaces 508 between some or all of the support ribs. In some implementations, the beam is formed of a metal, plastic, and/or a composite material.

Figure 3:
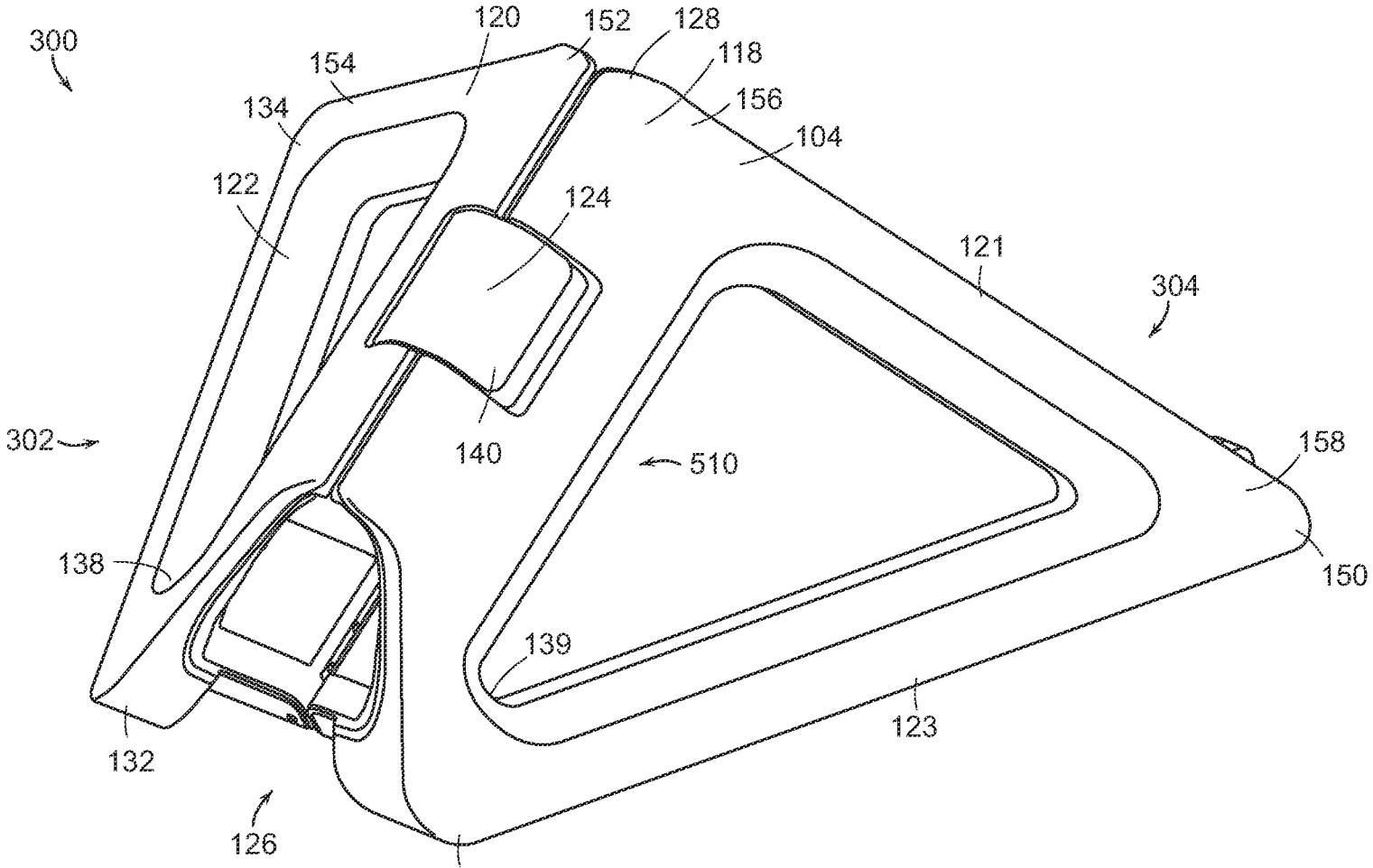
FIG. 3 is a perspective view of mounting apparatus.

FIG. 3 shows a perspective view 300 of mounting apparatus 104. According to one implementation, the connector 124 of mounting apparatus 104 includes a hinged latch 140 that is configured to secure the mounting apparatus 104 to the exercise equipment 102. FIG. 3 shows connector 124 with a close up view of hinged latch 140 In some implementations, the first elongate support member 118 defines a channel 406 between the connector 124 and a hinged back panel 510 when the hinged back panel 510 is in a closed position and the connector 124 is in a closed position.

In some implementations, mounting apparatus 104 includes a triangular support apparatus for securing exercise equipment 102. Mounting apparatus 104 includes a first hypotenuse side, e.g., elongate support member 122, arranged to extend adjacent to a surface such as surface 146 when exercise equipment 102 is in a storage position and/or orientation. The apparatus 104 may include a first leg side, e.g., elongate support member 118, having a hinged latch 104 arranged to couple the triangular support apparatus to a portion 106 of a frame of exercise equipment 102. The apparatus 104 may also include a second leg side, e.g., elongate support member 120, having at least one wheel, e.g., wheel 402, positioned proximate to an end adjacent to the first hypotenuse side, e.g., elongate support member 122. The first hypotenuse side, the first leg side, and the second leg side may form a first triangle 302. The apparatus 104 further includes a second hypotenuse side, e.g., elongate support member 123, arranged to extend adjacent to the surface 146 when exercise equipment 102 is in the storage position or orientation. The apparatus 104 may also include a third leg, e.g., elongate support member 121, having at least one wheel 404 positioned proximate to an end adjacent to the second hypotenuse side, e.g., elongate support member 123. The second hypotenuse side, the first leg side, and the third leg side may form a second triangle 304

Figure 4:
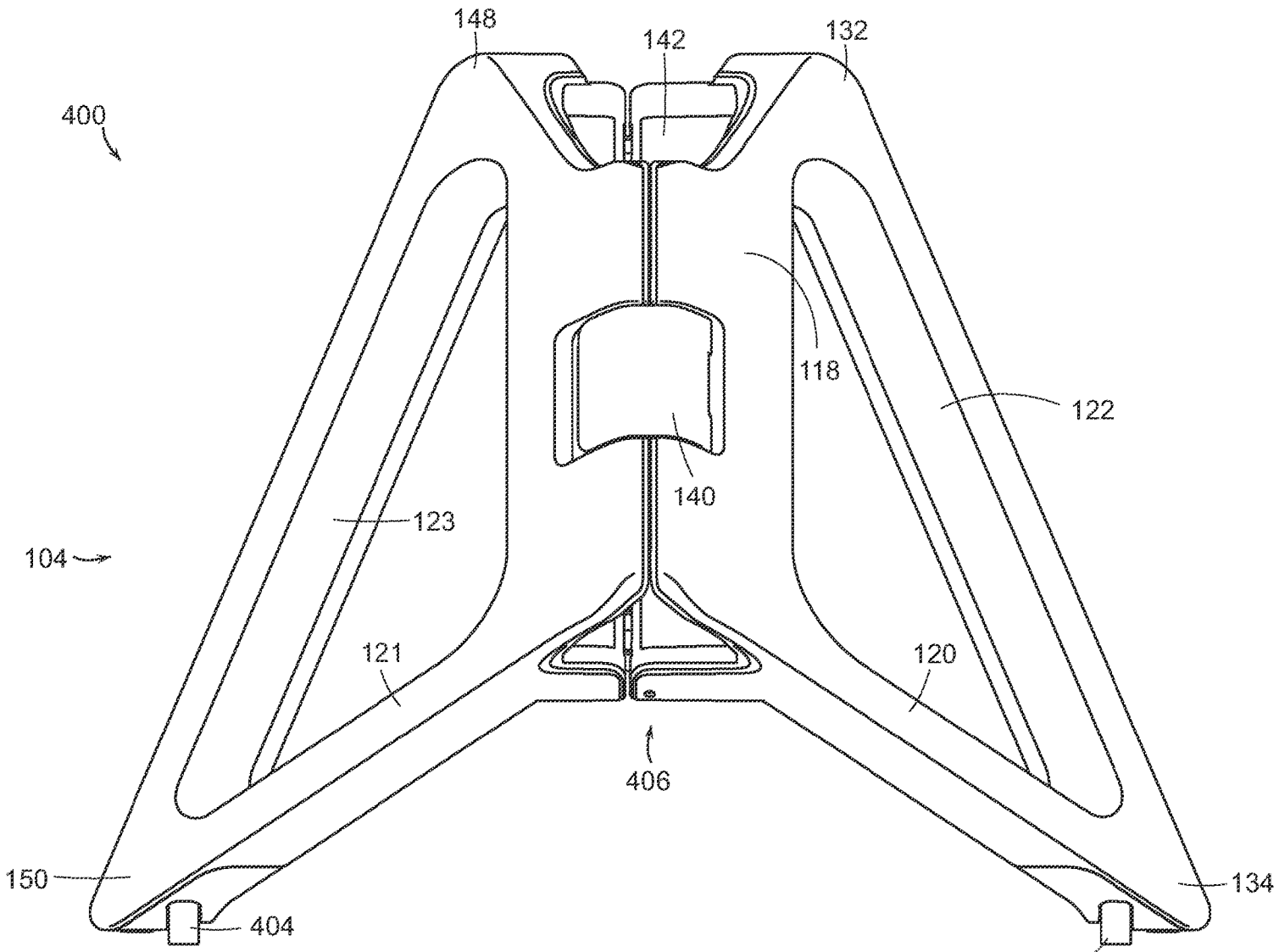
FIG. 4 is a top view of the mounting apparatus.

FIG. 4 shows a view 400 of latch 140 that may be used to clamp the mounting apparatus 104 to portion 106 of an exercise equipment 102. Latch 140 may be configured to secure and/or connect the mounting apparatus 104 to the exercise equipment. FIG. 4 also shows a close up view of latch 140 and grooved and/or ribbed interior 142, which in some implementations, can further help stabilize and secure the exercise equipment 102 to the mounting apparatus 104 when latch 140 swings open in a butterfly manner before subsequently swinging closed to secure and/or connect the mounting apparatus 104 to the exercise equipment 102.

Figure 5:
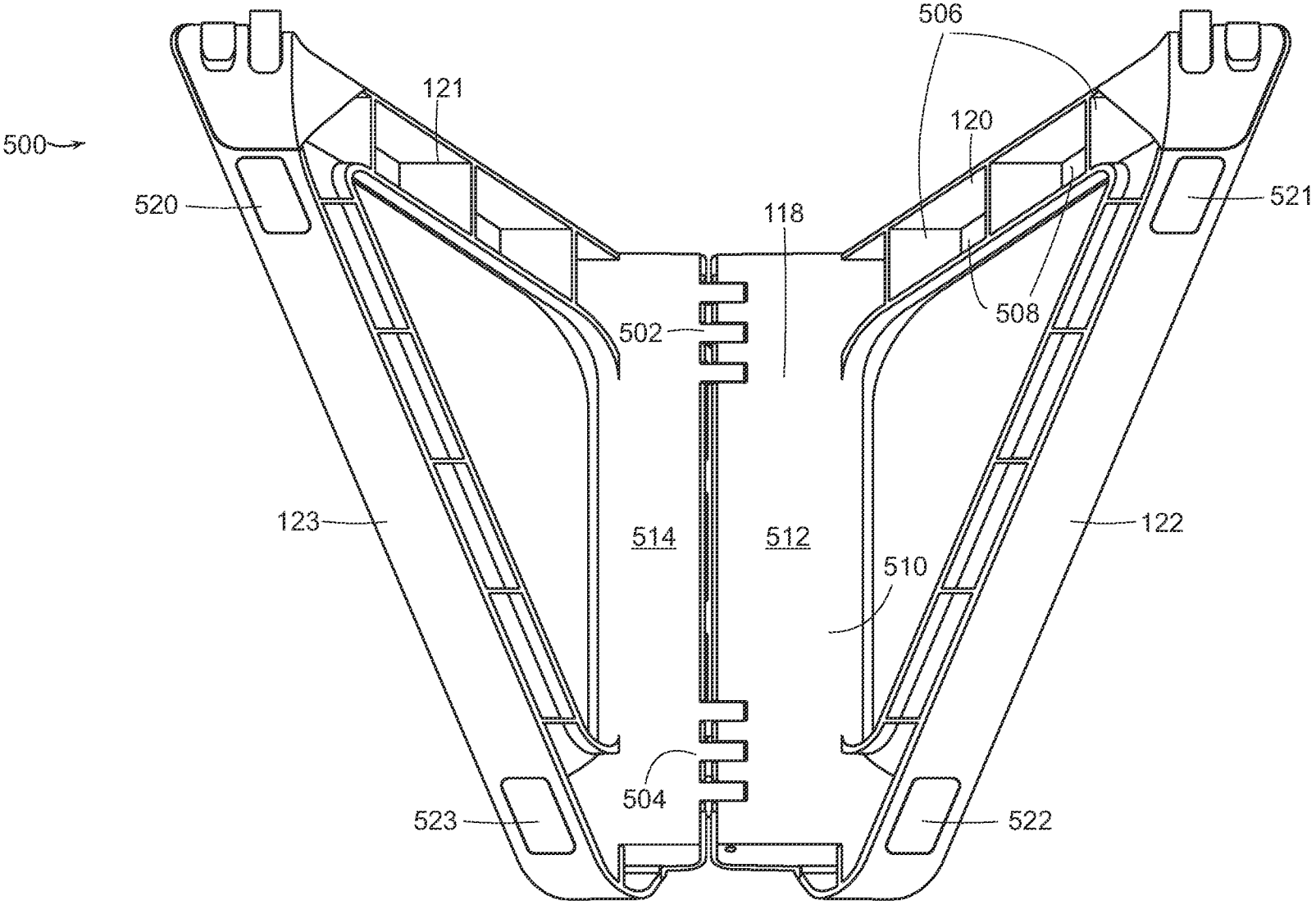
FIG. 5 is a bottom view of the mounting apparatus.

FIG. 5 shows a view 500 of hinges 502 and 504 that enable mounting apparatus 104 to swing open in a butterfly manner and swing closed to enable latch 140 to be engaged to clamp mounting apparatus 104 to portion 106 of exercise equipment 102. In some implementations, the first elongate support member 118 includes a hinged back panel 510 having a first side 512 and second side 514. The first side 512 and second 514 may be configured to rotate to a closed position when the first side 512 and second side 514 are aligned in substantially the same plane and to rotate to an open position when the first side 512 and the second side 514 are not aligned in the same plane. While hinges 502 and 504 include multiple interlocking fingers joined by a pivot pin (not shown), hinges 502 and 504 may be configured in a number of ways to enable mounting apparatus 104 to swing open and closed. For example, hinges 502 and 504 may include a flexible material such as, without limitation, plastic, cloth, and/or rubber configured to flex or bend and, thereby, enable mounting apparatus 104 to open and close. Additionally, latch 140 and hinges 502 and 504 may be arranged in a complementary manner to form a portion of connector 124. In other implementations, connector 124 and/or hinged latch 140 may include additional latching components such as, without limitation, a bolt latch, a spring latch, a slam latch, a swinging latch, a cam latch, a gate latch, a turn latch, a compression latch, a magnetic latch, a draw latch, a hasp latch, and/or a hook and eye latch.

Figure 6:
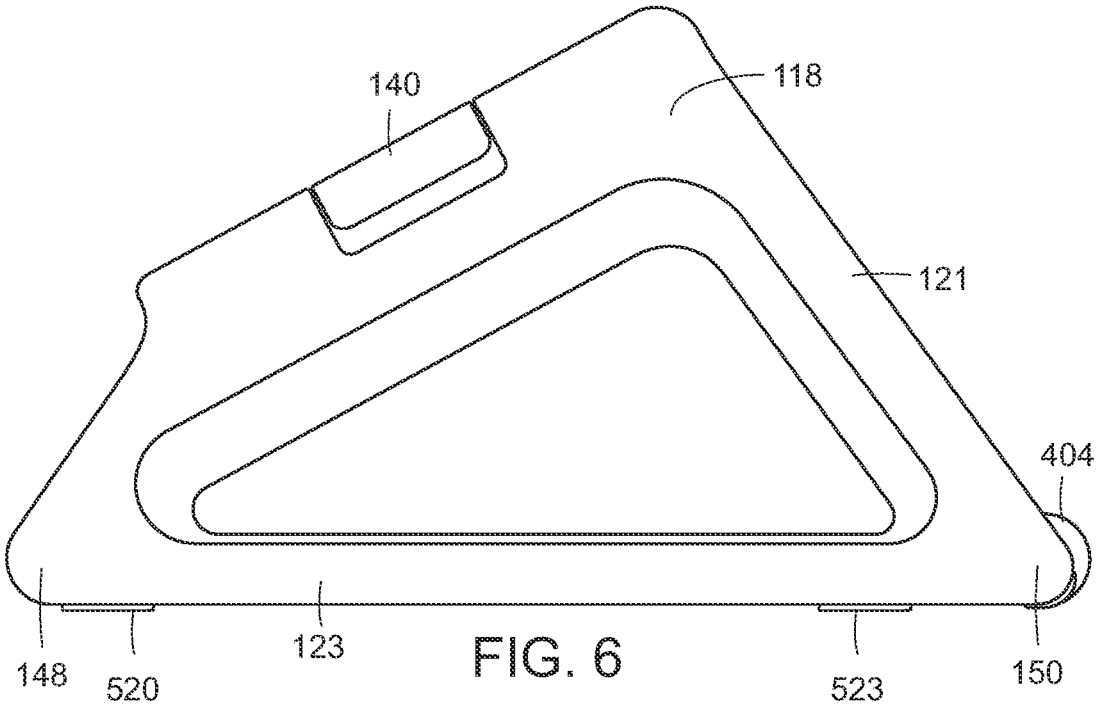
FIG. 6 is an anterior side view of the mounting apparatus.

FIG. 6 shows an anterior side view 600 of mounting apparatus 104.

Figure 7:
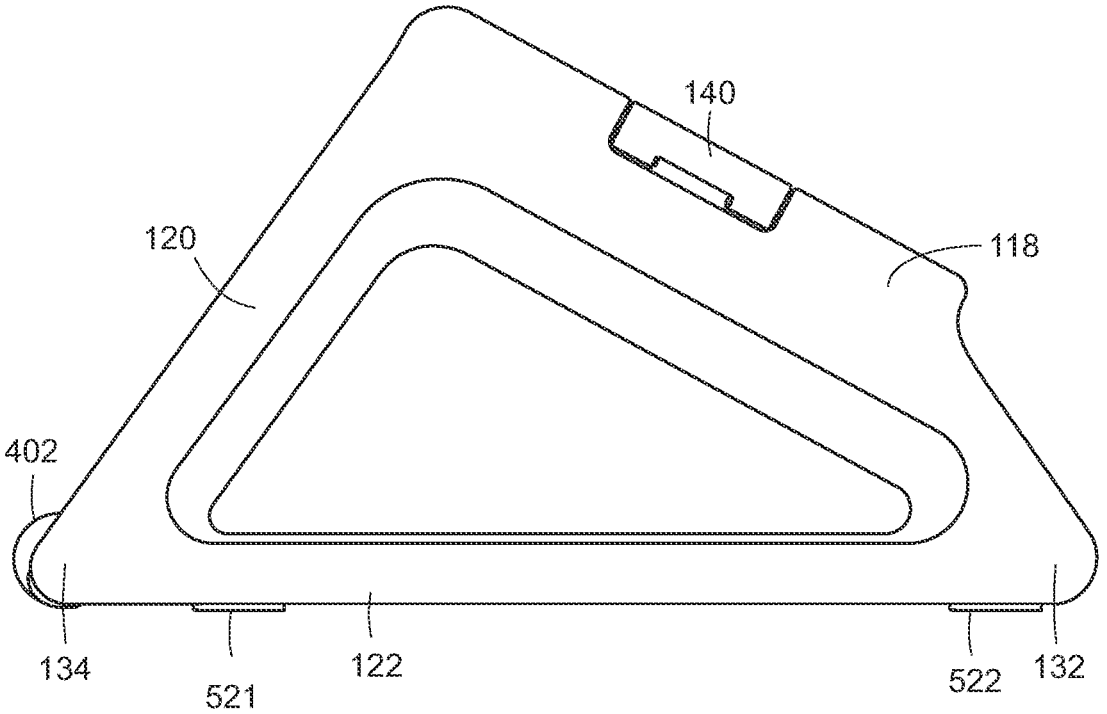
FIG. 7 is a posterior side view of the mounting apparatus.

FIG. 7 shows a posterior side view 700 of the mounting apparatus 104. FIGS. 6 and 7 show wheel 404 and 402 respectively, positioned at or proximate second end 150 of the third elongate support member 123 and second end 134 of the second elongate support member 122 to enable the mounting apparatus 104 to move along the surface 146.

Figure 8:
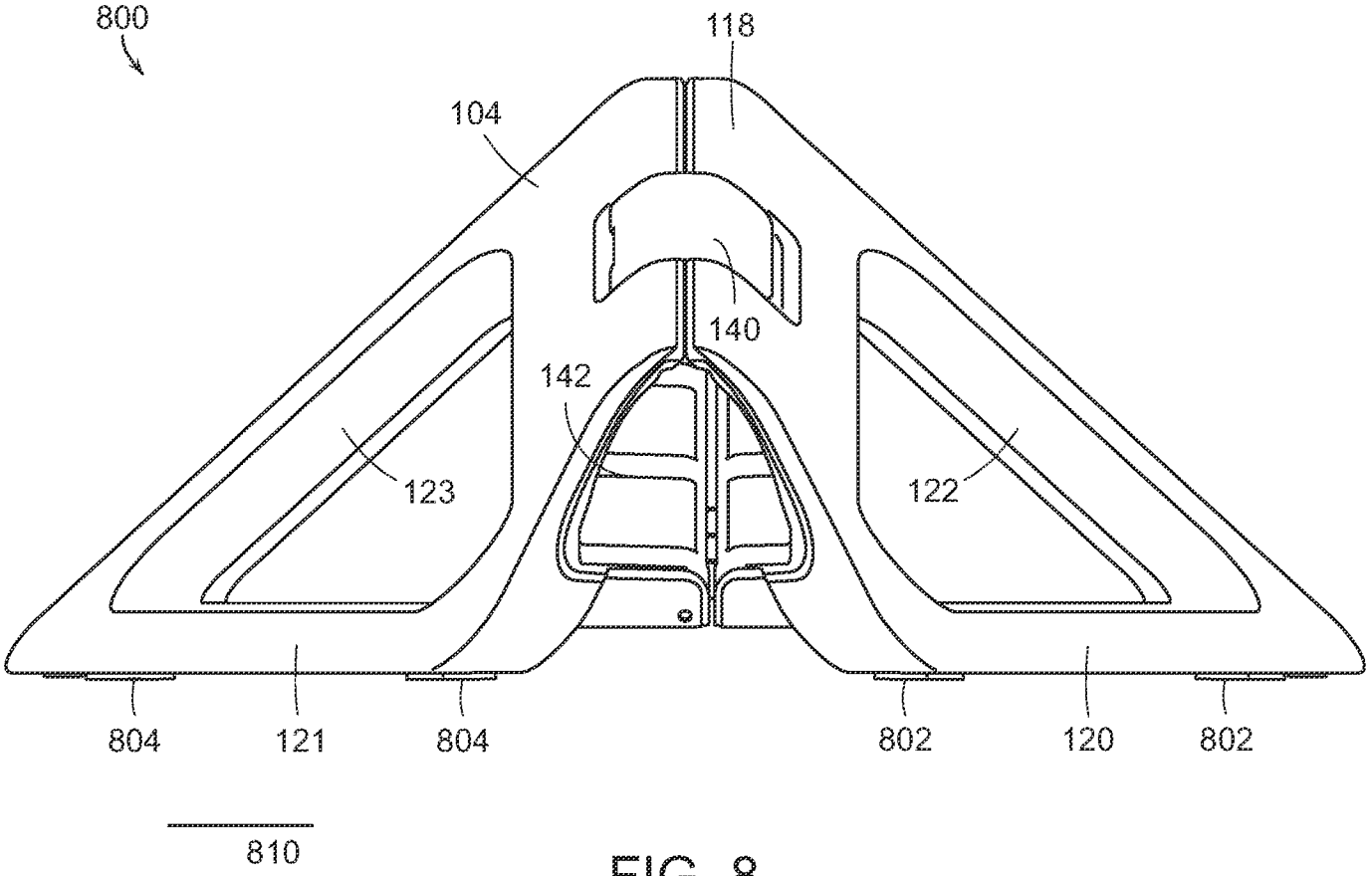
FIG. 8 is a front view of the mounting apparatus.

FIG. 8 shows a front view 800 of mounting apparatus 104 and provides a view of grooved and/or ribbed interior 142. At least two stabilizers 802 and 804 can be positioned on opposing first elongate support members 120 and 121 which may stabilize the mounting apparatus 104 when it is not connected to exercise equipment 102. According to some implementations, mounting apparatus 104 includes stabilizers 802 and 804 to further support mounting apparatus 104 and prevent unexpected or undesired movement and/or sliding along surface 810. Although not shown in FIG. 8, stabilizers and/or non-skid pads 520, 521, 522, and 522, which can be seen in FIGS. 5-7, may be affixed to the outer surface of the second elongate support member 122 and/or the third elongate support member 123 to minimize scratching or to provide non-skid adhesion to a surface such as surface 810 or 146 when the exercise equipment is connected to the mounting apparatus 104 and in the storage orientation.

Figure 9:
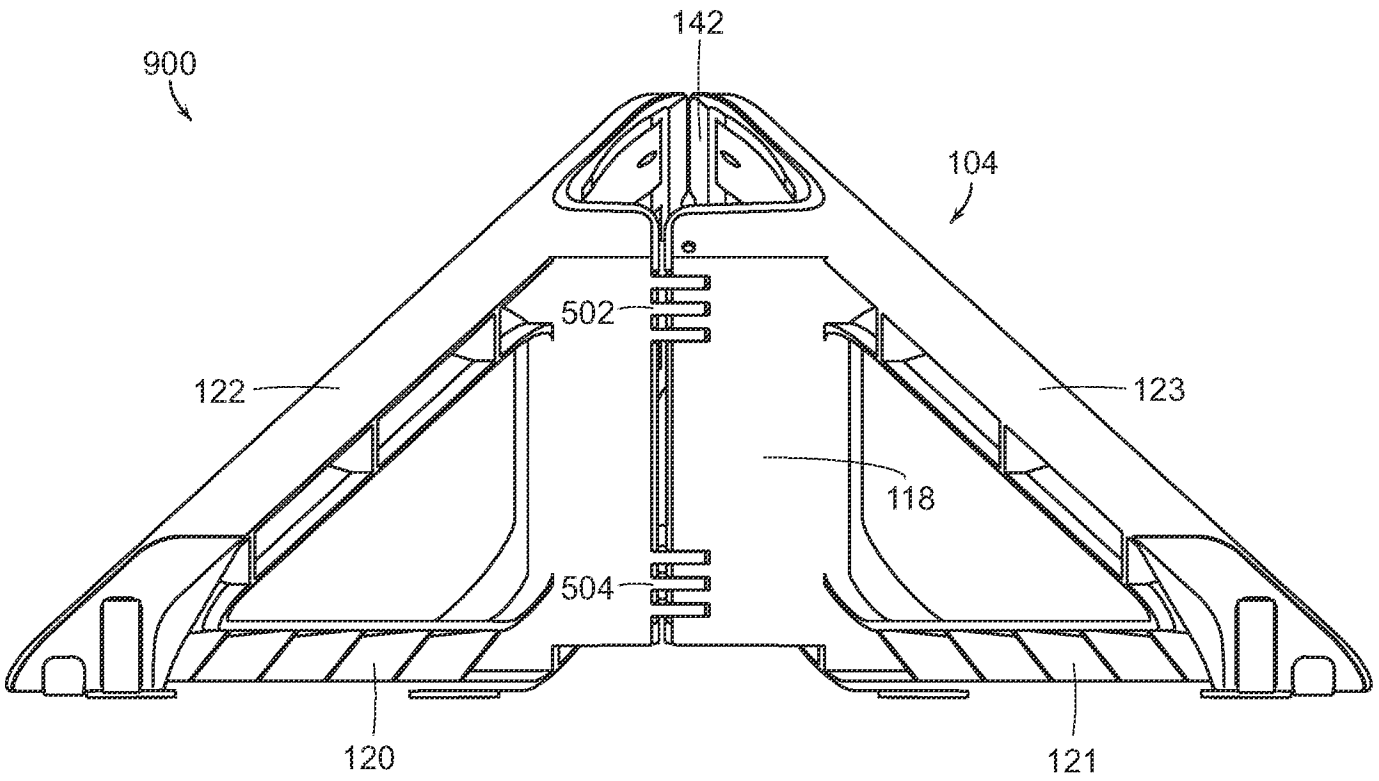
FIG. 9 is a back view of the mounting apparatus.

FIG. 9 shows a back view 900 of mounting apparatus 104 as an opposing perspective of view 800 in FIG. 8. Grooved and/or ribbed interior 142 is further illustrated, along with perspectives of grooved and/or ribbed second elongate support members 122 and grooved and/or ribbed third elongate support members 123. The support ribs within the interior of elongate support members 118, 122, 123, 120, and 121 may provide internal lateral support within the support members to increase the strength and rigidity of the support members and/or beams which, in turn, may stabilize to the mounting apparatus 104 when the mounting apparatus 104 is secured to exercise equipment 102 and holding exercise equipment 102 in the storage orientation.

According to another aspect, mounting apparatus 104 includes a triangular support apparatus for securing exercise equipment. The triangular support apparatus may include a hypotenuse side, including a hinged latch and a grooved interior. Thereby, the hinged latch and grooved interior may be configured to secure an exercise equipment disposed upright. Triangle support apparatus may also include an opposite side including two grooved support beams oriented at a right angle. The triangular support apparatus may further include an adjacent side, including two grooved horizontal support beams. The opposite side and the adjacent side may meet at a first and a second shared angle joining the two grooved support beams oriented at a right angle and the two grooved horizontal support beams respectively. The first and the second shared angle may include at least one wheel on each of the first and the second shared angle.

Figure 10:
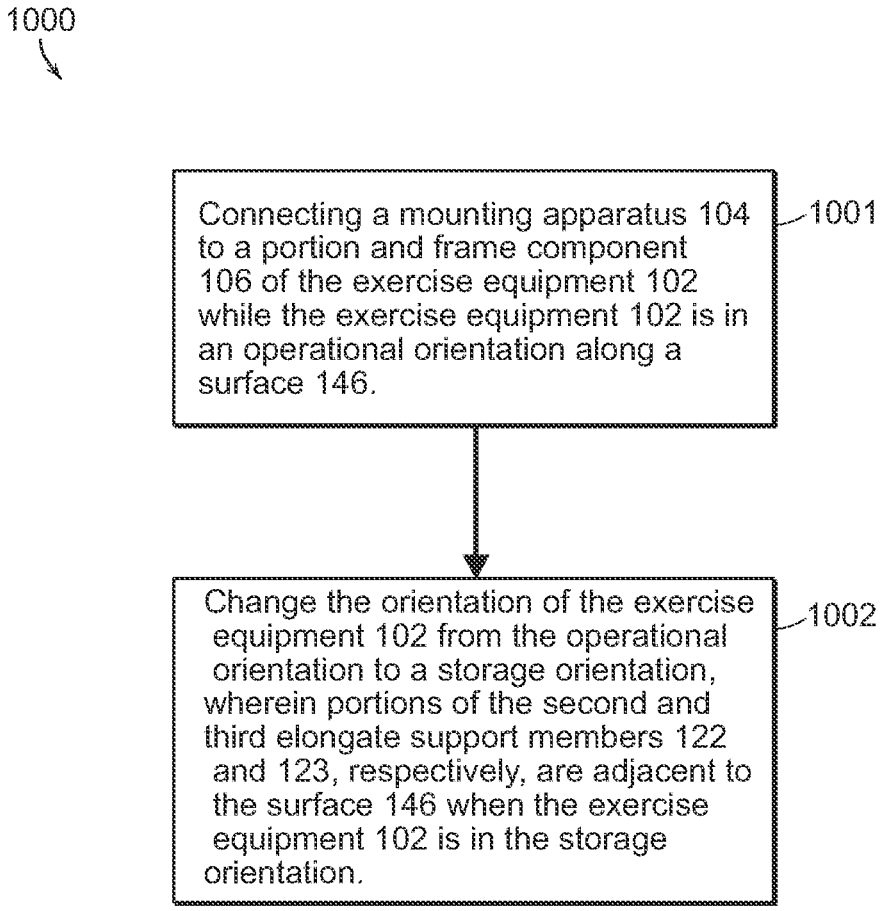
FIG. 10 is an exemplary process for storing exercise equipment.

FIG. 10 is an exemplary process 1000 for storing exercise equipment 102 including: connecting a mounting apparatus 104 to a portion and frame component 106 of the exercise equipment 102 while the exercise equipment 102 is in an operational orientation along a surface 146 (Step 1001). For example, when hinged latch 140 and/or connector 124 is in an open butterfly configuration, a user can slide mounting apparatus 104 onto a portion and frame component 106 of the exercise equipment 102 while the exercise equipment 102 is in an operational orientation along a surface 146 before swinging connector 124 and hinged latch 140 closed to secure and stabilize the exercise equipment 102.

According to some implementations, the mounting apparatus 104 includes, i) a first elongate support member 118 having a first end 126 and second end 128 and a connector 124 therebetween that enables the connecting to the exercise equipment 102, ii) a second elongate support member 122 having a first end 132 meeting the first end 126 of the first elongate support member 118, wherein the second elongate support member 122 is not in contact with the surface 146, and iii) a third elongate support member 123 having a first end 148 meeting the first end 126 of the first elongate support member 118. The process 1000 may further include changing the orientation of the exercise equipment 102 from the operational orientation to a storage orientation, wherein the second and third elongate support members 122 and 123, respectively, extend within a plane that is substantially parallel to the surface 146 (Step 1002).

According to one implementation, changing the orientation of the exercise equipment 102 includes tilting the exercise equipment 102 toward the surface 146 until the portion of the second elongate support member 122 and third elongate support member 123 contacts the surface 146. According to another implementation, connecting a mounting apparatus 104 to a portion and frame component 106 of the exercise equipment 102 while the exercise equipment 102 is in an operational orientation along a surface 146 includes engaging the connector 124 with the portion of a frame 106 of the exercise equipment 102. According to some implementations, the user can then choose to move exercise equipment 102 by way of, for example, at least one wheel 402 or 404 on mounting apparatus 104, or instead, leave exercise 102 and mounting apparatus 104 at the original location where the connector 124 and/or hinged latch 140 was engaged. According to some implementations, exercise equipment 102 can further be secured to a wall by way of one or more straps.

According to one implementation, a fourth elongate support member 120 includes a first end 152 and second end 154. The first end 152 may be connected to the second end 128 of the first elongate support member 118 and the second end 154 may be connected to a second end 134 of the second elongate support member 122. According to another implementation, at least one of the first, second, and third elongate support members 118, 122, and 123, respectively, includes at least two beams arranged to be engaged together when the mounting apparatus 104 is connected to the exercise equipment 102 and arranged to be spaced apart when the mounting apparatus 104 is not connected to the exercise equipment 102.

Elements or steps of different implementations described may be combined to form other implementations not specifically set forth previously. Elements or steps may be left out of the systems or processes described previously without adversely affecting their operation or the operation of the system in general. Furthermore, various separate elements or steps may be combined into one or more individual elements or steps to perform the functions described in this specification.

Other implementations not specifically described in this specification are also within the scope of the following claims.

What is claimed is:

1. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members; and a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members; wherein the second end of the second elongate support member is spaced away from the second end of the third elongate support member to form a third vertex of a third angle between the second and third elongate support members, and when the exercise equipment is in an operational orientation along a surface and the mounting apparatus is connected to the exercise equipment, the second and the third elongate support members are not in contact with the surface.

2. The mounting apparatus of claim 1, wherein when the exercise equipment is in a storage orientation along the surface and the mounting apparatus is connected to the exercise equipment, a portion of the second elongate support member and a portion of the third elongate support member are in contact with the surface.

3. The mounting apparatus of claim 2, wherein the second and third elongate support members extends within a plane that is substantially parallel to the surface.

4. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members;

a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members; and a fourth elongate support member including a first end and a second end, the first end of the fourth elongate support member meeting a second portion of the first elongate support member, the second end of the fourth elongate support member meeting a portion of the second elongate support member, wherein the second end of the second elongate support member is spaced away from the second end of the third elongate support member to form a third vertex of a third angle between the second and third elongate support members.

5. The mounting apparatus of claim 4, wherein the first end of the fourth elongate support member meets the second end of the first elongate support member and the second end of the fourth elongate support member meets the second end of the second elongate support member.

6. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members;

a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members; and a fifth elongate support member including a first end and a second end, the first end of the fifth elongate support member meeting a second portion of the first elongate support member, the second end of the fifth elongate support member meeting a portion of the third elongate support member, wherein the second end of the second elongate support member is spaced away from the second end of the third elongate support member to form a third vertex of a third angle between the second and third elongate support members.

7. The mounting apparatus of claim 6, wherein the first end of the fifth elongate support member meets the second end of the first elongate support member and the second end of the fifth elongate support member meets the second end of the third elongate support member.

8. The mounting apparatus of claim 4, wherein the first, second, and fourth elongate support members form a first triangular arrangement.

9. The mounting apparatus of claim 6, wherein the first, third, and fifth elongate support members form a second triangular arrangement.

10. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members; and a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members, wherein the angle of at least one of the first angle and the second angle is between 1 degree and 90 degrees, and the second end of the second elongate support member is spaced away from the second end of the third elongate support member to form a third vertex of a third angle between the second and third elongate support members.

11. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members; and a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members; wherein the second end of the second elongate support member is spaced away from the second end of the third elongate support member to form a third vertex of a third angle between the second and third elongate support members, wherein at least one of the first angle and the second angle is between 45 degrees and 90 degrees, and the second end of the second elongate support member is spaced away from the second end of the third elongate support member to form a third vertex of a third angle between the second and third elongate support members.

12. The mounting apparatus of claim 1, wherein at least one of the first angle and the second angle is configured to allow the exercise equipment to rest on the mounting apparatus in the storage orientation.

13. The mounting apparatus of claim 1, wherein a distance between the second end of the second elongate support member and the second end of the third elongate support member is wider than a width of the first elongate support member.

14. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members;

a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members; and at least one wheel positioned at or proximate to at least one of the second end of the second elongate support member and second end of the third elongate support member to allow the mounting apparatus to move along the surface, wherein the second end of the second elongate support member is spaced away from the second end of the third elongate support member to form a third vertex of a third angle between the second and third elongate support members.

15. The mounting apparatus of claim 14, further comprising:

a fourth elongate support member including a first end and a second end, the first end of the fourth elongate support member meeting a second portion of the first elongate support member, the second end of the fourth elongate support member meeting a portion of the second elongate support member; and a fifth elongate support member including a first end and a second end, the first end of the fifth elongate support member meeting a second portion of the first elongate support member, the second end of the fifth elongate support member meeting a portion of the third elongate support member, wherein each of the first, second, third, fourth, and fifth elongate support members includes a beam.

16. The mounting apparatus of claim 15, wherein the beam includes one or more support ribs.

17. The mounting apparatus of claim 15, wherein the beam is formed of at least one of a metal, plastic, and a composite material.

18. The mounting apparatus of claim 1, wherein the connector includes a hinged latch being configured to secure the exercise equipment to the mounting apparatus.

19. A mounting apparatus for exercise equipment comprising:

a first elongate support member having a first end and a second end, the first elongate support member including a connector positioned along a first portion of the first elongate support member and arranged to detachably connect to a portion of the exercise equipment;

a second elongate support member having a first end and a second end, the first end of the second elongate support member meeting the first end of the first elongate support member at a first vertex, the second end of the first elongate support member being spaced away from the second end of the second elongate support member to form the first vertex of a first angle between the first and second elongate support members; and a third elongate support member having a first end and a second end, the first end of the third elongate support member meeting the first end of the first elongate support member at a second vertex, the second end of the first elongate support member being spaced away from the second end of the third elongate support member to form the second vertex of a second angle between the first and third elongate support members, wherein the second end of the second elongate support member is spaced away from the second end of the third elongate support member to form a third vertex of a third angle between the second and third elongate support members, and the first elongate support member includes a hinged back panel having a first side and second side, the first side and second being configured to rotate to a closed position where the first side and second side are aligned in substantially the same plane and to rotate to an open position where the first side and the second side are not aligned in the same plane.

20. The mounting apparatus of claim 18, wherein the first elongate support member defines a channel between the connector and hinged back panel when the hinged back panel is in a closed position and the connector is in a closed position.

21. A method for storing exercise equipment comprising:

connecting a mounting apparatus to a portion of the exercise equipment while the exercise equipment is in an operational orientation along a surface, the mounting apparatus including: i) a first elongate support member having a first end and a second end and a connector therebetween that allows the connecting to the exercise equipment, ii) a second elongate support member having a first end meeting the first end of the first elongate support member, and iii) a third elongate support member having a first end meeting the first end of the first elongate support member, wherein portions of the second and third elongate support members are adjacent to the surface when the exercise equipment is in the operational orientation; and changing an orientation of the exercise equipment from the operational orientation to a storage orientation, wherein a portion of the second elongate support member is in contact with the surface, and changing the orientation of the exercise equipment includes tilting the exercise equipment toward the surface until the portion of the second elongate support member contacts the surface.

22. A method for storing exercise equipment, comprising:

connecting a mounting apparatus to a portion of the exercise equipment while the exercise equipment is in an operational orientation along a surface, the mounting apparatus including: i) a first elongate support member having a first end and a second end and a connector therebetween that allows the connecting to the exercise equipment, ii) a second elongate support member having a first end meeting the first end of the first elongate support member, and iii) a third elongate support member having a first end meeting the first end of the first elongate support member, wherein portions of the second and third elongate support members are adjacent to the surface when the exercise equipment is in the operational orientation; and changing an orientation of the exercise equipment from the operational orientation to a storage orientation, wherein a portion of the second elongate support member is in contact with the surface, and connecting includes engaging the connector with the portion of a frame of the exercise equipment.

23. A method for storing exercise equipment comprising:

connecting a mounting apparatus to a portion of the exercise equipment while the exercise equipment is in an operational orientation along a surface, the mounting apparatus including: i) a first elongate support member having a first end and a second end and a connector therebetween that allows the connecting to the exercise equipment, ii) a second elongate support member having a first end meeting the first end of the first elongate support member, and iii) a third elongate support member having a first end meeting the first end of the first elongate support member, wherein portions of the second and third elongate support members are adjacent to the surface when the exercise equipment is in the operational orientation; and changing an orientation of the exercise equipment from the operational orientation to a storage orientation, wherein a portion of the second elongate support member is in contact with the surface, and a fourth elongate support member includes a first end and second end, the first end being connected to the second end of the first elongate support member and the second end being connected to a second end of the second elongate support member.

24. The method of claim 23, wherein at least one of the first, second, and third elongate support members includes at least two beams arranged to be engaged together when the mounting apparatus is connected to the exercise equipment and arranged to be spaced apart when the mounting apparatus is not connected to the exercise equipment.

25. A triangular support apparatus for securing exercise equipment comprising:

a first hypotenuse side, wherein the first hypotenuse side is arranged to extend adjacent to a surface when the exercise equipment is in a storage position;

a first leg side including a hinged latch arranged to couple the triangular support apparatus to a portion of a frame of the exercise equipment;

a second leg side including at least one wheel positioned proximate to an end adjacent to the first hypotenuse side, wherein the first hypotenuse side, the first leg side, and the second leg side form a first triangle;

a second hypotenuse side, wherein the second hypotenuse side is arranged to extend adjacent to the surface when the exercise equipment is in the storage position; and a third leg side including at least one wheel positioned proximate to an end adjacent to the second hypotenuse side, wherein the second hypotenuse side, the first leg side, and the third leg side form a second triangle.

26. The mounting apparatus of claim 1, wherein the exercise equipment is a rowing machine.

27. The mounting apparatus of claim 4, wherein the exercise equipment is a rowing machine.

28. The mounting apparatus of claim 6, wherein the exercise equipment is a rowing machine.

29. The mounting apparatus of claim 10, wherein the exercise equipment is a rowing machine.

30. The mounting apparatus of claim 11, wherein the exercise equipment is a rowing machine.

31. The mounting apparatus of claim 14, wherein the exercise equipment is a rowing machine.

32. The mounting apparatus of claim 19, wherein the exercise equipment is a rowing machine.

33. The method of claim 21, wherein the exercise equipment is a rowing machine.

34. The method of claim 24, wherein the exercise equipment is a rowing machine.

35. The method of claim 23, wherein the exercise equipment is a rowing machine.

36. The triangular support apparatus of claim 25, wherein the exercise equipment is a rowing machine.

* * * * *